US006402641B1

(12) United States Patent
Lee

(10) Patent No.: US 6,402,641 B1
(45) Date of Patent: Jun. 11, 2002

(54) MOVABLE TARGET FOR SPORTS GOAL

(76) Inventor: William J. Lee, 5881 Pagenhopf Rd., Maple Plain, MN (US) 55359

( * ) Notice: Subject to any disclaimer, the term of this patent is extended or adjusted under 35 U.S.C. 154(b) by 4 days.

(21) Appl. No.: 09/684,223

(22) Filed: Oct. 6, 2000

Related U.S. Application Data

(60) Provisional application No. 60/158,264, filed on Oct. 7, 1999.

(51) Int. Cl.[7] ..... A63B 69/00

(52) U.S. Cl. ..... 473/446; 473/478; 473/454; 273/127 R

(58) Field of Search ..... 273/127 R, 398, 273/399, 400, 401, 402; 473/446, 471, 478, 454–456

(56) References Cited

U.S. PATENT DOCUMENTS

| | | | | | |
|---|---|---|---|---|---|
| 2,126,102 | A | * | 8/1938 | Fowler | 473/456 |
| 3,328,033 | A | * | 6/1967 | Hendry | 248/328 |
| 3,856,298 | A | * | 12/1974 | Frantti | 273/127 R |
| 4,083,559 | A | * | 4/1978 | Owen, Jr. | 359/872 |
| 4,245,843 | A | | 1/1981 | Griggs | 273/393 |
| 4,497,485 | A | * | 2/1985 | Macosko | 273/401 |
| 4,842,283 | A | | 6/1989 | LeBel et al. | 273/392 |
| 4,863,166 | A | * | 9/1989 | Becera et al. | 273/401 |
| 4,948,147 | A | * | 8/1990 | Pallanca | 273/396 |
| 5,351,948 | A | * | 10/1994 | Thomas | 273/400 |
| 5,433,434 | A | * | 7/1995 | Helmetsie | 473/446 |
| 5,511,775 | A | * | 4/1996 | Parks | 273/400 |
| D377,673 | S | | 1/1997 | Henrickson | D21/200 |
| 5,634,640 | A | | 6/1997 | McCarrel | 473/446 |
| 5,664,784 | A | * | 9/1997 | Redlich et al. | 273/396 |
| 5,800,290 | A | | 9/1998 | Barry | 473/438 |
| 5,944,318 | A | * | 8/1999 | Payton | 273/402 |
| 5,993,334 | A | | 11/1999 | McNamara | 473/446 |

* cited by examiner

*Primary Examiner*—Mark S. Graham
(74) *Attorney, Agent, or Firm*—Kinney & Lange, P.A.

(57) ABSTRACT

A target device is positionable in an infinite number of positions within a sports goal having left and right upright members and a crossbar connecting the upright members. The device includes a main body generally comprised of a sheet material. A pair of spaced apart adjustable straps engaging an upper portion of the main body and are used for suspending the main body from the crossbar of the goal. An elastic cord extends through a lower portion of the main body and has first and second ends for attaching to the left and right upright members, respectively.

4 Claims, 3 Drawing Sheets

MOVABLE TARGET FOR SPORTS GOAL

CROSS-REFERENCE TO RELATED APPLICATION(S)

Applicant claims the priority date of U.S. Provisional Application No. 60/158,264 filed on Oct. 7, 1999.

BACKGROUND OF THE INVENTION

The present invention generally relates to targets for use in sporting goals such as soccer goals and hockey goals.

In the absence of a goal tender, a target that is suitable for shooting at by players is needed. Typical targets that have been used in the past are often quite large and are mounted as either a permanent or removable fixture within the goal. For example, in hockey, a board is attached to the goal posts or crossbar, the board having openings in the upper left and right and lower left and right corners and along the bottom center of the goal.

Some other targets of the prior art are discussed in the patents listed below:

| | |
|---|---|
| Griggs | 4,245,843 |
| LeBel et al. | 4,842,283 |
| McCarrel | 5,634,640 |
| Barry | 5,800,290 |
| McNamara | 5,993,334 |
| Henrickson | Des. 377,673 |

BRIEF SUMMARY OF THE INVENTION

The present invention includes a target device positionable in an infinite number of positions within a sports goal having left and right upright members and a crossbar connecting the upright members. The device includes a main body generally comprised of a sheet material. A pair of spaced apart adjustable straps engaging an upper portion of the main body and are used for suspending the main body from the crossbar of the goal. An elastic cord extends through a lower portion of the main body and has first and second ends for attaching to the left and right upright members, respectively.

DETAILED DESCRIPTION

Figure 1:
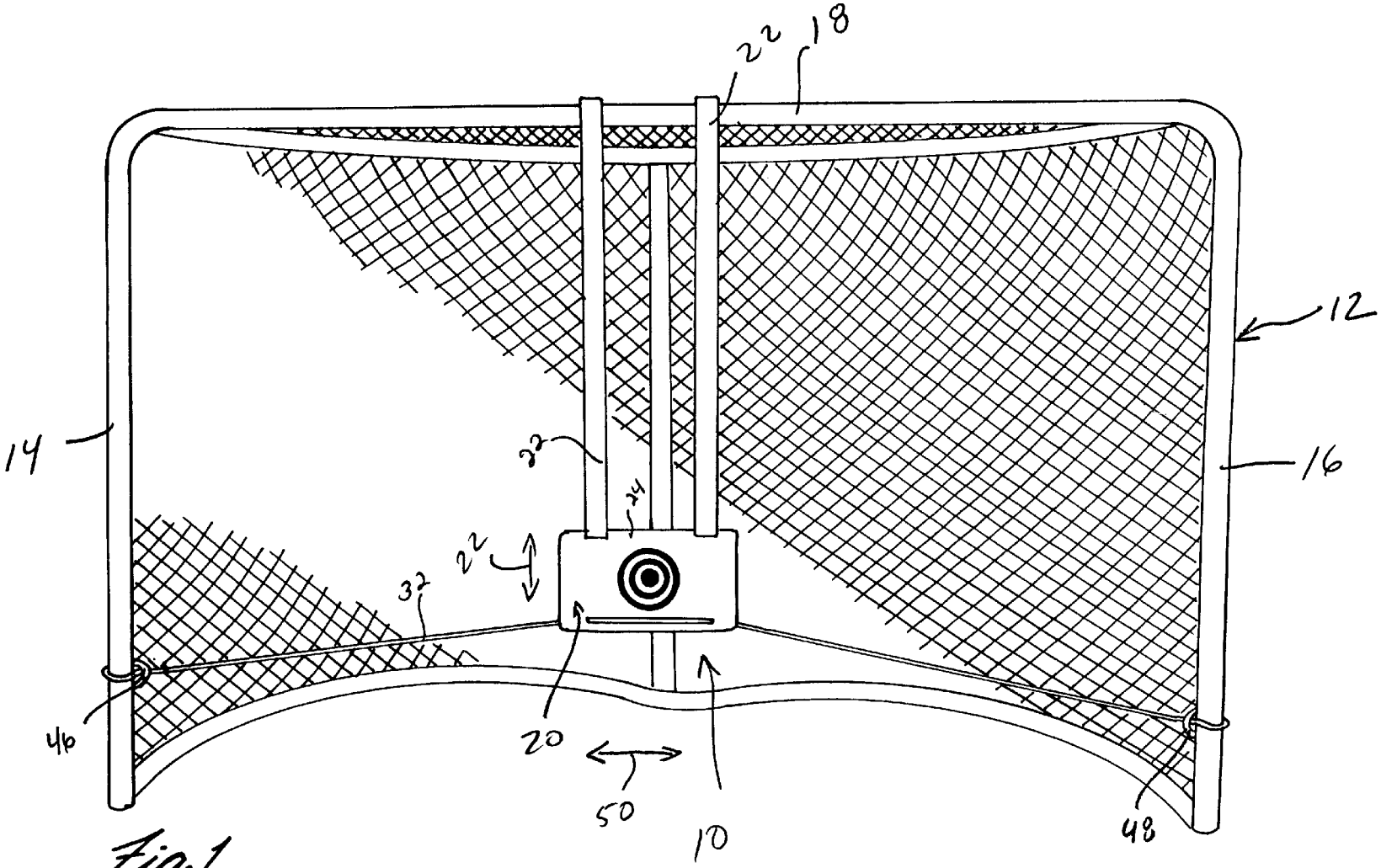
FIG. 1 is an elevational view of the target of the present invention centrally located in a hockey goal.

The present invention generally indicated at 10 in FIG. 1 acts as a shooting target that is suspended within a goal generally indicated at 12 such as a ice hockey goal specifically illustrated in FIG. 1. The target 10 is suspended along a plane that is defined by left and right uprights 14 and 16 and a crossbar 18 that connects the left and right uprights 14 and 16. Although an ice hockey goal is specifically illustrated in the drawings, it should be understood that other goals such as for example, a soccer goal, a roller hockey goal or a lacrosse goal is also within the scope of the present invention along with other goals used in similar games.

The target 10 includes a target member 20 at which a puck is shot. The target 10 is used in the absence of a goal tender or can be used to develop specific shooting skills. The target member 20 is constructed of a material that can withstand the impact of a hockey puck. Preferably, the material is polymeric such as polyethylene sheeting having a thickness in the range of ¼ inch to one inch. The thickness given is exemplary and the use of other materials may result in different thicknesses being used. The important factor is that the target member should withstand the impact of the object being propelled such as a hockey puck hitting the member repeatedly over time.

One other purpose of the target 10 is to improve the shooting ability of the player at a particular spot in the goal. Therefore, the target member 18 must be movable and is of a size sufficiently small so that it challenges the player, but sufficiently large so it does not discourage the player from shooting at the target. In one preferred embodiment, the target as illustrated in the photographs is approximately 8½×11", positioned in a goal having an opening that is 4'×6' such as a hockey goal.

Figure 3:
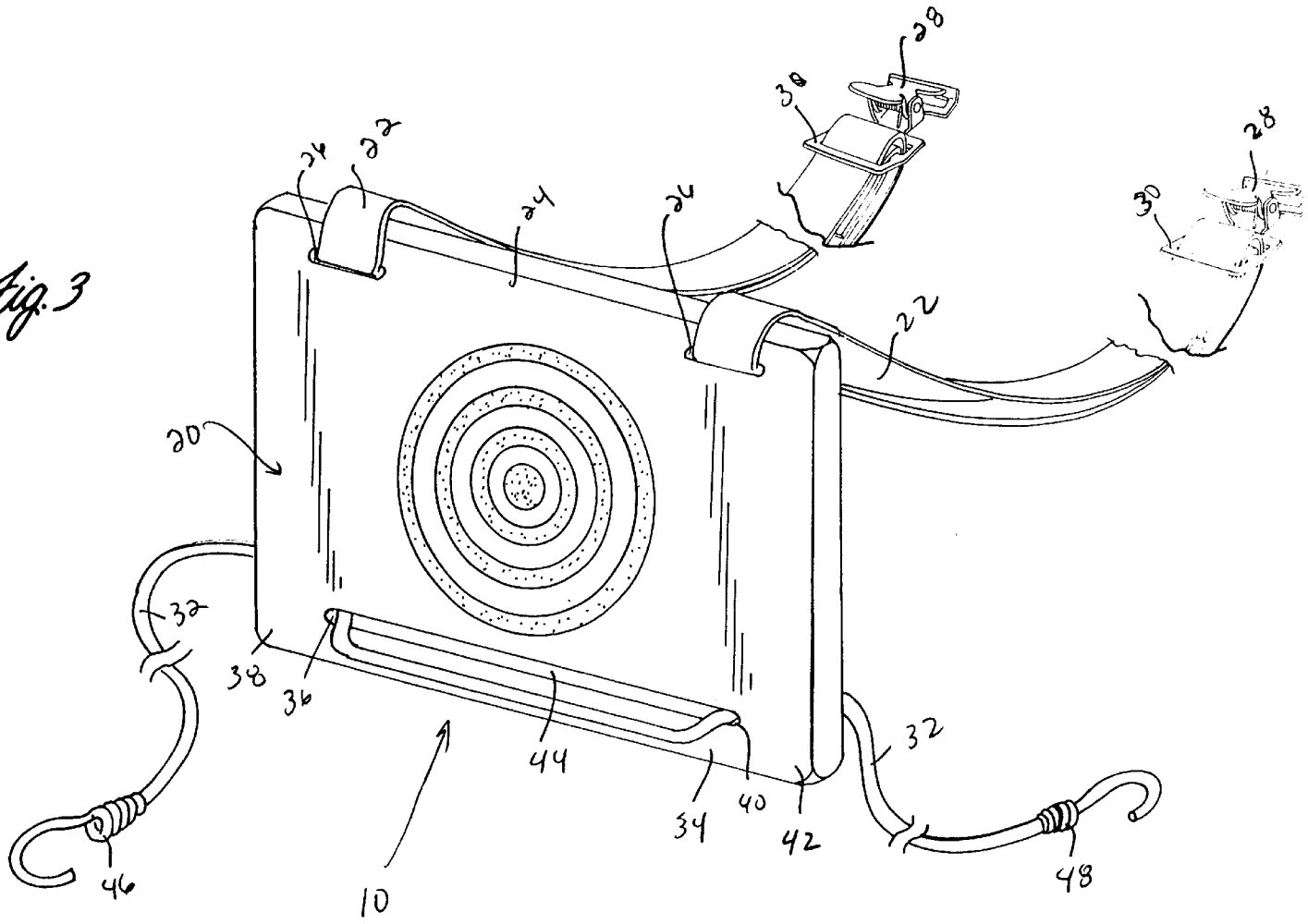
FIG. 3 is a perspective view of the target of the present invention.

The target member 20 is suspended from the crossbar 18 by a pair of vertically disposed straps 22 that are attached to the target 20 at an upper end 24. The straps 22 are spaced apart and extend through slots 26 in the target member 20, as best illustrated in FIG. 3. The straps 22 are sufficiently spaced apart so that the target member remains along the plane defined by the uprights 14 and 16 and crossbar 18 and does not turn from a hit by a hockey puck. Preferably, the straps are made of a non-stretchable and flexible material.

The straps 22 are attached to the crossbar 18 through the use of buckles 28. Each of the buckles has an adjusting member 30 through which the length of the straps 22 may be adjusted so as to position the target member 20 at a selected vertical height. Such adjusting members are commonly used to adjust strap lengths. The type of strap used in the present invention is not important nor how the strap is attached to the target. What is important is that the straps are adjustable so that the target may be moved upwardly or downwardly as indicated by arrows 22 in FIG. 1.

For positioning the target 18 in a horizontal direction in the goal area that is between the uprights 14 and 16, an elastic cord 32 sometimes known as a bungee cord or shock cord is secured to a lower end 34 of the target member 20. The elastic cord extends through an aperture located proximate one lower corner 38 and a second aperture 40 located proximate an opposing lower corner 42 of the members. Between the apertures 36 and 40, the elastic cord 32 is disposed within a slot 44 formed in the target member 20. The slot 44 is sufficiently wide to accept the elastic cord 32 and sufficiently narrow to secure the cord 32 therewithin and sufficiently deep such that the elastic cord 32 does not extend beyond the surface of the target member 20 that is being hit by the hockey puck or other objects.

The elastic cord further includes hook ends 46 and 48 secured at opposing ends. Such hook ends are commonly used with elastic cords. Of course, other types of ends for attaching the cord to the uprights 14 and 16 are includable within the present invention.

As illustrated in FIG. 1, the elastic cord is hooked at one end to one upright 14 and at the other end to the upright 16 using the hook ends 46 and 48. To move the target member 20 in a horizontal direction as indicated by arrows 50, the elastic cord 32 is moved through the slot 44 in either the left or the right direction as desired, thereby moving the target member. The straps 22 are then hooked about the crossbar 18 in the selected horizontal position and adjusted in length to position the target member at a selected height.

Figure 2:
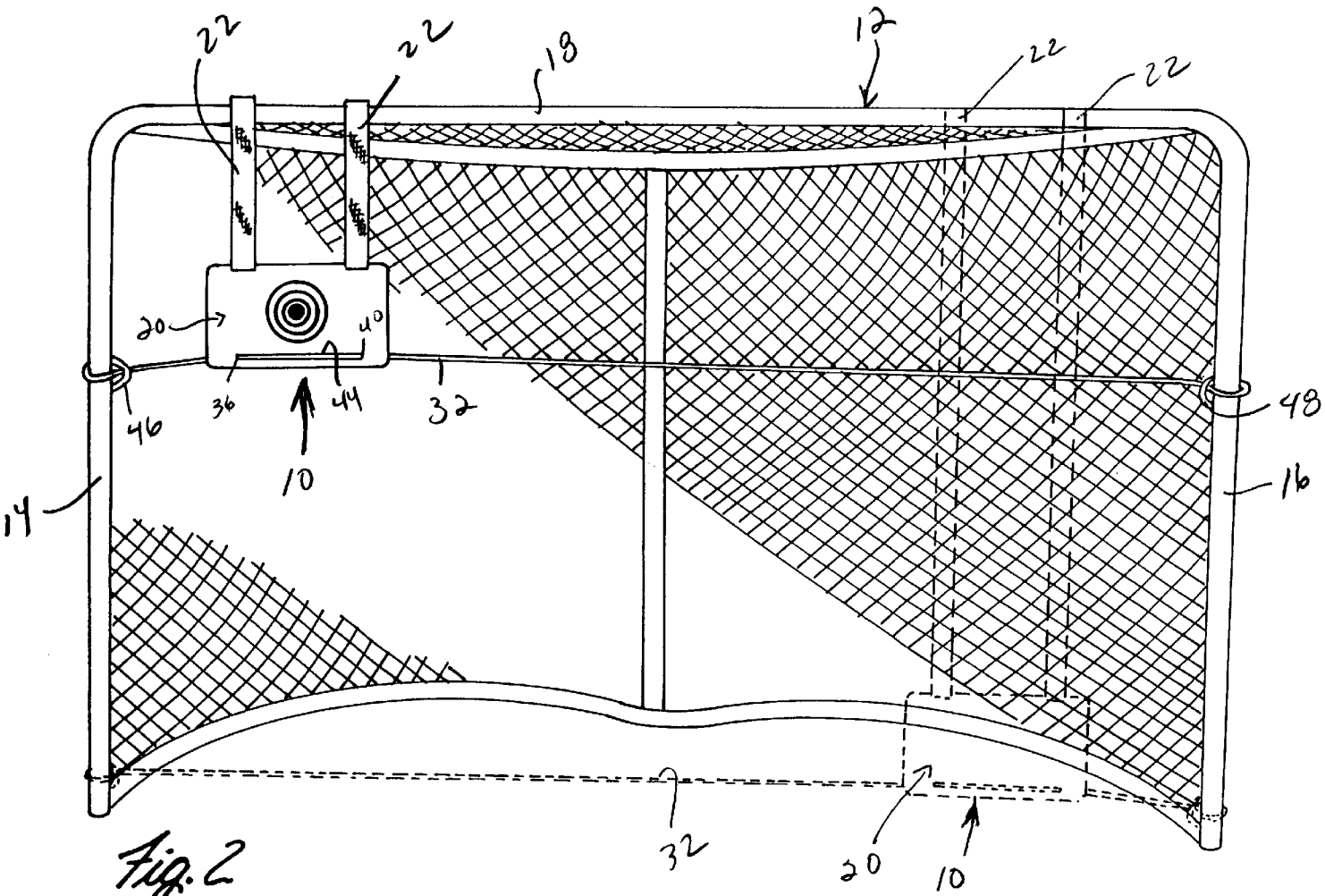
FIG. 2 is an elevational view of the target of the present invention positioned in an upper lefthand comer of the hockey goal.

FIG. 2 illustrates the target 10 in an upper left corner position in the hockey goal 12. As illustrated, the cord 32 has been moved through the apertures 36 and 40 and slot 44 of the target member 20 to position the target member 20 proximate the left upright 14. The straps 22 have been shortened and positioned to extend over the crossbar 18 in the position proximate the upright 14. As illustrated, the target 20 is now in a position for players to shoot at the target in the upper lefthand corner of the goal 12.

In a similar fashion, the target member 20 is moved horizontally toward the upright 16 as illustrated in broken lines in FIG. 2. The straps 22 are lengthened to permit the target member to be moved downwardly away from the crossbar 18 while also being positioned near the upright 16. Now the players can shoot pucks in the lower right hand comer of the goal 12.

As is easily understood, the target member 20 is moveable to any position within the goal opening as defined by the uprights 14 and 16 and cross member 18.

The combination of the elastic cord 32 and the straps 22 results in the hockey puck falling directly to the ground within the goal 12 after the puck hits the member 20 primarily due to the elastic nature of the cord 32 and inelastic nature of the straps 22. The hockey puck does not rebound back to the player, but falls within the goal so that the hockey pucks are easily retrieved. Furthermore, in the preferred embodiment, the polyethylene sheeting resounds with a clear and loud "clack" as the puck hits the target member 20 indicating that the target member 20 has been hit, providing a sense of accomplishment to the hockey player.

Although the present invention has been described with reference to preferred embodiments, workers skilled in the art will recognize that changes may be made in form and detail without departing from the spirit and scope of the invention.

What is claimed is:

1. A target device for positioning within a sports goal, the goal being defined by left and right upright members and a crossbar connecting tile upright members, the device comprising.

a main body comprising a sheet material having an upper end portion and a lower end portion;

a pair of inelastic spaced apart straps adjustable in length engaging an upper portion of the main body; and an elastic cord extending through a lower portion of the main body having first and second ends for attaching to the left and right upright members, respectively.

2. The device of claim 1 wherein the main body further includes a pair of spaced apart apertures and a slot extending between the apertures along a surface of the main body and wherein the elastic cord extends between both apertures and is disposed within the slot.

3. The device of claim 1 wherein the main body is made of a polymeric material.

4. The device of claim 1 wherein the main body is about ¼ to one inch in thickness.

* * * * *